United States Patent [19]

Cervenka et al.

[11] 4,254,649

[45] Mar. 10, 1981

[54] TUBE BENDING DEVICE

[75] Inventors: Juraj Červenka; Jan Psenica; Miroslav Horak; Jiří Horák, all of Brno, Czechoslovakia

[73] Assignee: Prvni brnenska strojirna, narodni podnik, Brno, Czechoslovakia

[21] Appl. No.: 15,133

[22] Filed: Feb. 26, 1979

Related U.S. Application Data

[63] Continuation-in-part of Ser. No. 908,369, May 22, 1978, abandoned.

[30] Foreign Application Priority Data

May 31, 1977 [CS] Czechoslovakia ..... 3569-77

[51] Int. Cl.³ ..... B21D 7/16

[52] U.S. Cl. ..... 72/128; 72/342; 72/369

[58] Field of Search ..... 72/128, 149, 152, 155, 72/342, 364, 369

[56] References Cited

U.S. PATENT DOCUMENTS

| | | | |
|---|---|---|---|
| 783,716 | 2/1905 | Brinkman | 72/128 |
| 2,461,323 | 2/1949 | Hille | 72/342 X |
| 3,368,377 | 2/1968 | Hirayama et al. | 72/128 |
| 3,902,344 | 9/1975 | Stuart | 72/128 |
| 3,958,438 | 5/1976 | Somov et al. | 72/128 |
| 4,022,045 | 5/1977 | Riha | 72/128 |
| 4,122,697 | 10/1978 | Hanyo et al. | 72/128 |

*Primary Examiner*—Ervin M. Combs

*Attorney, Agent, or Firm*—Burgess, Ryan and Wayne

[57] ABSTRACT

The invention relates to a tube bending device, especially for thin walled tubes made from austenitic materials, e.g., for power engineering. The device consists of a pressure truck, adjustable gear, inductor heating coil, cooling section and a bending arm. The tube to be bent is positioned with one end on the pressure truck, and the second end fixed to the bending arm, and is freely placed in the inductor gear and axially moved in the inductor gear on guide rollers of an adjustable gear.

7 Claims, 3 Drawing Figures

TUBE BENDING DEVICE

Figure 1:
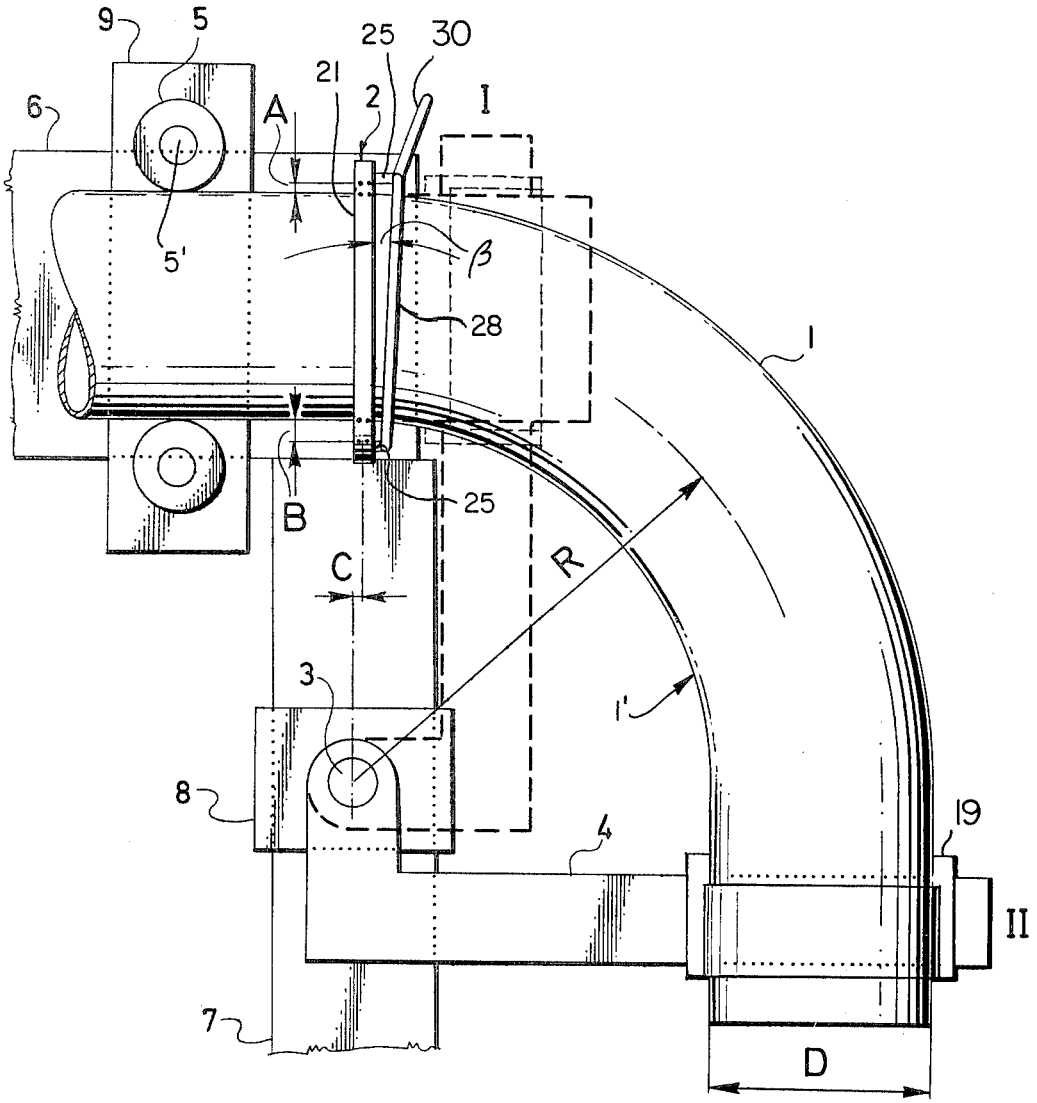

This application is a continuation-in-part of prior co-pending application Ser. No. 908,369 filed May 22, 1978, abanoned.

BACKGROUND OF THE INVENTION

This invention relates to a tube bending device, especially for thin walled tubes of large diameter made from austenitic materials.

Bending of piping made from austenitic high temperature steels, e.g., steels like Cr Ni 1810 and the other steels of similar composition, in required high quality indicators, is a very complicated engineering problem, in that high or low bend angles have been realized only by a few manufacturers. The available technical literature does not contain any information about bending of large diameter, thin-walled piping with the specific thickness, i.e. with a ratio of the wall thickness to the external tube diameter less than 5%.

The tubes from austenitic materials are now bent by heating on a bending plate, then on a bending machine with a pressure bending roller, and subsequently on a bending machine with a revolving arm. The bending plate of a common bending unit is a device consisting of a rugged horizontal circular revolving platform having a diameter of several meters and two vertical guide rolls disposed off the circuit of the revolving platform. In the top face of the revolving platform, vertical holes are formed in concentric circular rows. Two shell binding pins are adjustably located in the vertical holes. A tube to be bent is closed on both ends and its internal space is filled with tamped sand. The inner surface of thin walled tubes bent as described above frequently becomes wavy and the originally circular section is flattened. With regard to bed heat conductivity of austenitic steels, the inner surface of the tube deteriorates after long-term reheating in a gas fired furnace, with burned-in sand grains and adverse material structure effects along the whole section of the wall.

The bending machine with a pressure bending roller consists of a bed with a longitudinal slidingly located pressure truck, a drive unit fixed on one end of the bed and kinematically connected to the mentioned pressure truck by a motion screw. A carrier is fixed to the second end of the bed and provided with a transversely sliding support with a pivoted bending roller and further consists of an adjustable gear with guide rollers and an induction heating coil for medium frequency electrical heating of the formed tube. When the machine is in use, the pressure bending roller bends the tube, said tube axially passing through the induction heating coil into a pressure zone where pressure is provided by a hydraulic cylinder. With regard to a quick heating zone, the surface and material structure of the bent tube have a high quality after bending, but at the bending zone, inadmissible flattening occurs which remains in the finished product. On the bending machine with a pressure bending roller, it is also very difficult to achieve an exact bend radius.

Thin-walled austenitic piping with a specific thickness less than 5% cannot be bent on a medium frequency bending machine with a revolving arm. The bending machine with a revolving arm has, in plan view, a form of a capital letter "L", where the longer leg is a main bed with a drive unit, a slidingly located pressure truck, an adjustable gear and induction coil, and where the shorter leg is an auxiliary bed with slidingly located support, carrying a revolving bending arm. On the free end of the bending arm is arranged a vise for clamping of the front end of the bent tube. The back end of the bent tube is located in the pressure truck. This machine, however, cannot provide a continuous and smooth bend; cracks and abnormal ovality occur repeatedly. The number of defects grows quickly with decreasing bend radius.

The induction coil surrounds the periphery of the tube. The distance between the inductor and the outer surface of the tube, divided by the distance between the inductor and the inner surface of the tube is set at between 0.4 and 0.9 for best results. In the foregoing ratio, the outer surface of the tube is defined, referring to the bend to be made in the tube, as the longest chordal line of the bend and the inner surface as the shortest chordal line of the bend.

In addition to the foregoing, the inductor is provided with a cooling part as well as a heating part.

According to the invention, there is provided a tube bending device comprising means for applying pressure to move the tube through the device, such as a pressure truck, an adjustable gear, an inductor coil and means for bending the tube as it exits from the inductor coil, such as a revolving arm. The angle between the heating and cooling parts of the induction coil is in the range from 3 °–10°, the vertex of the angle $\beta$ being situated inside the bend of the tube.

Preferably, the plane of the inductor is offset with regard to the axis of a pin defining the rotational center of the revolving arm along the tube longitudinal axis by a distance defined by the formula $$C = X \cdot R / D$$

where coefficient X, determined experimentally by Applicant, is in the range of 0.1–4; C is the distance between the plane of the inductor and the axis of said pin, R is the mean radius of the bent section of the tube and D is the outer diameter of the tube. The shift C in location of the inductor is toward the rear of the tube.

A device according to the invention enables the fomation of a bent tube in a peripherally formed heating zone, which guarantees a continuous and smooth bend without cracking on the tension side. It is also possible to bend thin-walled piping with a specific thickness under 5%, and where it is possible to reach a fillet, the mean radius of which is equal to triple the mean diameter of the bent piping in this zone.

Figure 2:
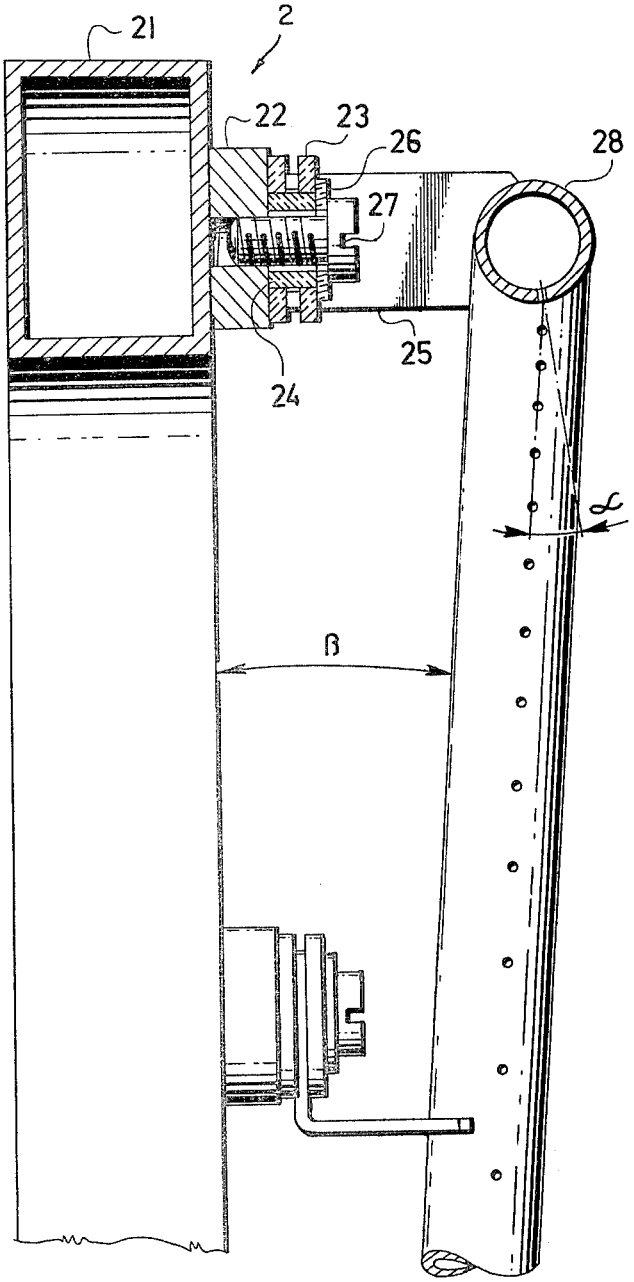
Figure 3:
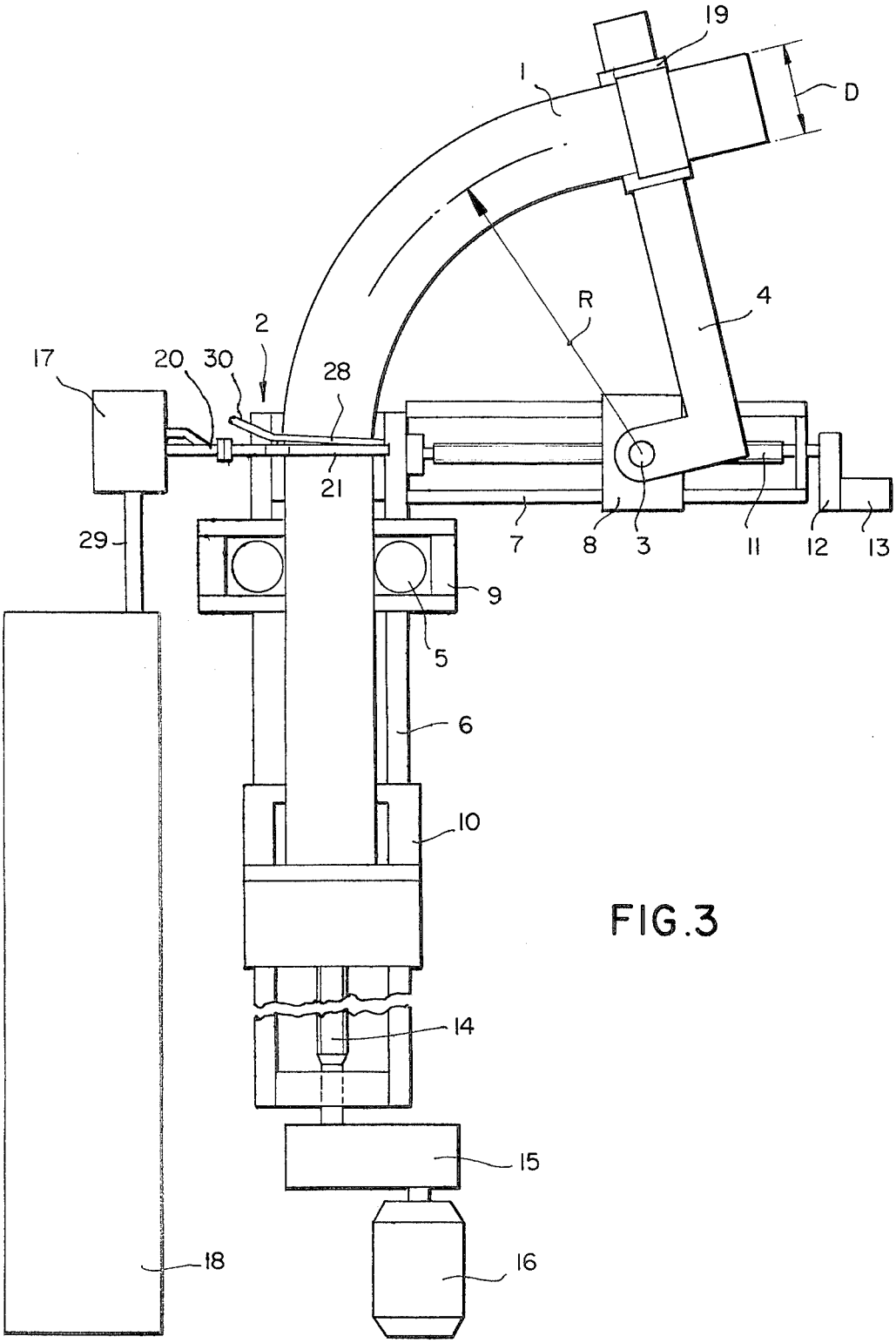

A preferred embodiment of the present invention will now be described by way of example with reference to the drawings, in which:

FIG. 1 shows a schematic partial plan view of the corner part of the device, FIG. 2 shows the partial axial section through the inductor gear; and FIG. 3 is schematic plan view of the complete device.

As shown in FIGS. 1 and 3 in plan view, the bending device itself has the shape of the letter L, where the longer straight part is the main bed 6 with the main driving unit arranged on the free end of the said main bed 6 and with a longitudinally movable pushing support 10, with the setting device and the induction heating apparatus 2 both arranged on the corner end of said main bed 6. The shorter straight part is the auxiliary bed 7, which bed is laterally attached by its corner end at a right angle to the corner end of the main bed 6. On the auxiliary bed 7, the auxiliary support 8 bearing the rotating bending arm 4 is longitudinally displaceably located. The auxiliary driving unit is arranged on the free end of the auxiliary bed 7. The induction heating apparatus 2 is connected by its hollow power supply arms 20 to the secondary winding of the electric transformer 17 located to the left of the bending machine with reference to FIG. 3. To the primary winding of the transformer 17, the source 18 of a middle frequency alternating electric current is connected by the connecting lines 29, said source being also located to the left of the said bending machine (FIG. 3). The source 18 consists of the set formed by the asynchronous electric motor and the middle frequency generator (not shown), arranged on one shaft, and further by a group of condensers for the compensation of the power factor. The three-phase asynchronous electric motor (not shown) is connected to the electric distribution network. The frequency of the one-phase alternating electric current supplied by the source 18 depends on the revolution frequency of the said set. Practically, the frequency of the middle frequency alternating electric current, considering the necessity of a narrow heating zone of the processed material, is on the order of about 1000 Hz.

The main driving unit formed by the main electric motor 16 and the main gear box 15 with respective couplings (not shown) is kinematically connected by the main motion screw 14 with the nut of the pushing support 10 (not shown). The support is fixedly mounted to the posterior corner of the tube 1 during the bending. The fixing device, arranged on the corner end of the main bed 6 between the induction apparatus 2 and the pushing support 10, consists of the body 9 on which are displaceably arranged two vertical fixing pins 5' with rotating guide rollers 5. The vertical fixing pins are set far enough apart so that the rollers are in contact with the tube having a diameter D.

Of course, the rollers are in rolling contact with the middle part of the axially displaceable tube 1.

Hollow power supply arms 20 are attached to the secondary winding of the transformer 17 located to the left of the bending machine as seen in FIG. 3. Power supply arms 20 are employed to carry electrical power to the induction heating apparatus 2.

To the primary winding of the said transformer 17 is connected a line 29 which in turn is connected to generating source 18 which in turn supplies the middle frequency alternating electric current. The source 18 is also located on the left of the bending machine as viewed in FIG. 3. The source comprises a set (not shown) consisting of an asynchronous electric motor and a middle frequency generator along with a group of condensers for compensating for the power factor. The asynchronous motor is a three phase asynchronous motor and is connected to the distribution network. But the frequency of the one phase alternating electric current supplied by the generating source 18 depends on the rotation frequency of the entire set, which is mounted on a shaft (not shown).

The front end of the bent tube 1 is clamped in a vise 19 adjustably arranged on the movable end of the bending arm 4. The fixed end of the bending arm 4 pivots on the vertical bending pin 3 fixed on the auxiliary support 8. The auxiliary driving unit consists of the auxiliary electric motor 13, the auxiliary gear box 12 and of couplings (not shown). The auxiliary driving unit is kinematically connected by means of the auxiliary motion screw 11 to the nut of the auxiliary support 8.

The induction heating apparatus 2, which essentially consists of the inductor or heating part 21 and the cooling part 28, has a flange attachment by hollow electrical connections of its heating part to the hollow power supply arms 20 of the secondary winding of the transformer 17, and by means of the admission tube 30 of its cooling part, it is connected to a water conduit (not shown).

In contradistinction to the present bending devices, which have the heating as well as the cooling parts arranged centrally with regard to the bent tubes, according to the invention, the special induction heating apparatus 2 in the bending machine with the bending arm 4 is set in a position which makes possible during the bending of the tube 1, the formation of a peripherally formed heating zone, guaranteeing continuous and smooth bends.

The special arrangement of the toroidal induction heating apparatus 2 shown in FIG. 2 involves the mutual inclination of its heating part formed by the hollow simple inductor 21 and of its cooling part formed by the hollow annular cooling ring 28. The said inclination in the horizontal bending plane amounts to angle $\beta$.

At the same time, the apex of the angle $\beta$ lies within the bend of the tube 1. To the front surface of the inductor 21 turned to the front end of the bent tube 1, are welded the cover plates 22 in regular spacing. In a similar way, on the front of the cooling ring 28 turned to the inductor 21, are welded the brackets 25 in corresponding regular spacing. The free curved ends of the brackets 25 are provided with fixing holes for the fixing screws 27. The fixing screws 27 pass through said fixing holes and are fixed in the front arranged tapered holes of the cover plates 22, thus mechanically connecting the cooling ring 28 with the inductor 21. The electric insulation of the curved ends of the brackets 25 from the inductor 21 is provided by means of the first insulating pad 23 and the second insulating pad 26 and of the insulating bushings 24 arranged on the stems of the fixing screws 27.

The mutual deflection of the heating part and the cooling part, amounting to the required angle $\beta$, is made possible by the different lengths of the brackets 25. The angle $\beta$ exerts an essential influence on the shaping of the heating zone of the tube wall. During bending all the forming processes and volume changes take place, in this heating zone.

The optimal value of the angle $\beta$ is in the range of 3° to 10°. Through the horizontal hollow electric supply lines and the flange connection with the hollow power supply arms 20, the cavity of the inductor 21 is connected to the cooling circuit (not shown).

Nozzle orifices are arranged in the wall of the hollow cooling ring 28, the axes of which are inclined at the angle $\alpha$ with regard to the middle section plane towards the front end of the tube 1. The described orientation of the nozzle aids to effectively limit (a desired effect) the width of the heated zone of the tube wall. This tube wall is heated in the heated zone to the required forming temperature.

The optimal size of the angle $\alpha$ varies from 10° to 20°. By the term "middle section plane" it is understood here the plane extending through the center of gravity of the sections of the cooling ring 28.

In the adjusted state, the induction heating apparatus 2 is displaced on one side with regard to the pin 3 and the tube 1, towards the front end of the tube 1, and on the other side is misaligned towards the bending center. In this adjusted state, the middle section plane of the inductor 21 is displaced with regard to the axis of the pin 3 of the bending arm 4 towards the corner end of the main bed 6 and thus also towards the front end of the tube 1. The said displacement amounts to the coordinate C (FIG. 1). The external clearance A between the inductor 21 and the external bend of the bent tube 1 is smaller than the internal clearance B between the inductor 21 and the internal bend of the bent tube 1.

It can be appreciated that the air clearance between the inductor 21 and the tube 1 is therefore continuously variable. Its maximal value is equal to the size of the inner clearance B, its minimal value being equal to the size of the external clearance A. In accordance with known electrophysical laws, the temperature height of the metal heated by electric conduction is within a certain range approximately inversely proportional to the size of the air clearance. It is therefore possible to obtain, by misaligning the inductor 21 towards the bending pin 3 of the bending arm 4, a higher temperature of the wall material on the external bend of the bent tube than on the inner bend thereof. The continuously variable air clearance between the inductor 21 and the tube 1 develops therefore in the wall tube material a continuously variable temperature field. Together with the mutual deviation of the heating part and the cooling part of the inductor 21, it forms in the tube wall during the forming process a continuous variable formed or bent zone.

In operational tests, it was discovered that the optimal ratio of the size of the external clearance A to the size of the internal clearance B is in the range of 0.4 to 0.9, the ratio being dependent especially on the frequency of the induced electric current of a material on the formed tube 1. An example of an appropriate induced electric current frequency is 1,000 Hz which would result in said ratio.

According to the tests, the tensile stress zone in the tube wall is displaced during bending towards the front end of the tube 1. With regard to the optimal course of the forming process, it is therefore indispensable that the induction apparatus be also displaced toward the front end of the tube by the difference delineated in FIG. 1 by the capital letter C. The size of the coordinate C given by the distance of the axis of the bending pin 3 from the middle section plane of the inductor 21 depends on the median radius R, on the external diameter D of the bent tube 1 and also on the coefficient X which is determined by testing. Given an optimal size for coordinate C, the forming process is fully continuous, the bent tube showing minimal deformations as a result of the forming process.

Before starting to bend and after the preliminary adjustment of the bending device has been effected, the tube 1 is inserted into the induction heating apparatus 2 in the starting position I shown in dotted lines in FIG. 1. In said starting position I, the posterior end of the tube 1 is set on the pushing support 10 and its front end is fixed in the vise 19 of the bending arm 4. Then, the middle part of the tube is fixed between guide rollers 5 of the adjustment device and the supply of the electric current into the inductor heating apparatus 2. Afterwards, the values controlling admission of the cooling water into the inductor 21 and the cooling ring 28 are opened.

After the zone of the tube wall is heated to the forming temperature, the main driving unit of the pushing support 10 is put into operation. In its forward movement, the pushing support 10 pushes the tube 1 through the guiding device and the induction heating apparatus 2 into the end position II, bending the tube 1 to the required middle radius R. The size of the middle radius R of the bend is adjustable by the position of the vise 19 on the bending arm 4 and by the position of the auxiliary support 8 on the auxiliary bed 7. The peripherally heated zone, formed by means of induced eddy currents, in the tube wall material, is maintained during the described forward movement of the tube 1, with the required parameters being held by cooling water flowing out of the cooling ring 28 through nozzle holes on the surface of the tube 1.

In this way, the forming process takes place only in a very narrow strip, as the relatively cool material of the tube wall before the formed heated zone and after the formed heated zone does not permit any deviation, and thus prevents the formation of undesirable deformations on the bent tube 1. After the bend has been finished, the flows of electric current and cooling water are shut off, and bent tube 1 is loosened and removed.

Some modifications can be made in the above described apparatus without departing from the spirit and scope of the invention.

It is intended to cover all such modifications which fall within the spirit and scope of the invention as defined in the claims appended hereto and what we claim is:

1. Apparatus for bending thin walled tubing, comprising:

an annular induction heating coil having an axis disposed in a first plane;

an annular fluid spray cooling coil disposed adjacent said heating coil and having an axis disposed in a second plane and means for directing a coolant fluid toward the space surrounded by said cooling coil closely adjacent said second plane;

means for positioning a tube to be bent so that said tube extends longitudinally through said coils with the portion of said tube corresponding to the outer side of the bend to be made disposed at a clearance distance A from the adjacent inner surface of the heating coil, and the portion of said tube corresponding to the inner side of the bend to be made disposed at a greater clearance distance B from the adjacent inner surface of the heating coil, the ratio A:B being in the range of about 0.4 to 0.9;

means for pushing said tube through said coils in the direction extending from said heating coil toward said cooling coil;

means for holding and bending said tube upon emergence thereof from said coils;

said second plane being inclined at an angle between about 3° and 10° with respect to said first plane, said planes intersecting along a line passing through the region partially surrounded by the bend of said tube, whereby said tube to be bent is heated in a wedge-shaped annular zone prior to bending thereof, thus providing a smooth and continuous bend of said tube.

2. The tube bending apparatus of claim 1 wherein said means for holding and bending said tube is mounted for pivotal movement, the pivot axis being located a selected distance from the plane of the heating coil, said distance being defined by the equation $$C=X(R/D)$$

where C is the distance from the plane of the heating coil in a direction away from the bend of the tube, X is an experimentally determined coefficient and is between 0.1 and 4, R is the mean radius of the bend to be made in the tube and D is the external diameter of the tube.

3. The apparatus according to claim 1 wherein said coolant fluid directing means of said cooling coil comprises a plurality of nozzles, each of said nozzles being oriented at an angle of about 10° to 20° with respect to said second plane, on the side of said second plane remote from said first plane.

4. The apparatus according to claim 1 wherein the line of intersection of said planes is directed toward the radial center of the bend to be made in the tube.

5. The apparatus according to claim 1 further comprising an L-shaped bed having two legs, said pushing means being mounted on one of said legs and said holding and bending means including a rotatable arm movably mounted on the other of said legs, and means for moving said pushing means to push said tube through the annular openings of said heating and cooling coils.

6. The apparatus according to claim 1 wherein said rotatable arm comprises vise means for fixedly connecting said tube to said revolving arm during the bending operation.

7. The apparatus of claim 1 wherein said tube has a ratio of wall thickness to external tube diameter of less than about 5%.

* * * * *